US006293049B1

(12) United States Patent
Shaw

(10) Patent No.: US 6,293,049 B1
(45) Date of Patent: Sep. 25, 2001

(54) METHOD AND APPARATUS FOR INSTALLING A WINDOW ASSEMBLY

(75) Inventor: Barry L. Shaw, Euless, TX (US)

(73) Assignee: Atrium Companies, Inc., Dallas, TX (US)

( * ) Notice: Subject to any disclaimer, the term of this patent is extended or adjusted under 35 U.S.C. 154(b) by 0 days.

(21) Appl. No.: 09/401,353

(22) Filed: Sep. 27, 1999

(51) Int. Cl.[7] ..... E05D 15/22
(52) U.S. Cl. ..... 49/183; 49/454
(58) Field of Search ..... 49/63, 453, 454, 49/455, 465, 463, 181, 183

(56) References Cited

U.S. PATENT DOCUMENTS

| | | | | |
|---|---|---|---|---|
| 2,429,054 | * | 10/1947 | Gatter | 49/183 |
| 2,509,582 | * | 5/1950 | Webster | 24/55 |
| 3,529,381 | * | 9/1970 | Grossman | 49/183 |
| 4,356,667 | * | 11/1982 | Malachowski | 49/454 |
| 4,831,778 | * | 5/1989 | Schmidt et al. | 49/453 |
| 4,869,020 | * | 9/1989 | Andres | 49/454 X |

* cited by examiner

*Primary Examiner*—Jerry Redman

(74) *Attorney, Agent, or Firm*—Baker Botts L.L.P.

(57) ABSTRACT

A method and apparatus for installing a window assembly (10) is disclosed. The window assembly (10) includes a window frame (12), an upper (14), and an upper sash support (80). The window frame (12) includes two vertical jambs (18) and (20), a frame head (22), and a frame sill (24). The upper sash (14) includes two vertical stiles (26) and (28), an upper rail (30) and a lower rail (31). Each vertical stile (26) and (28) has an upper end and a lower end. At least one vertical stile (26) lower end has a web (41). The upper sash support (80) is adapted to receive the web (41) and support the upper sash (14). The method for installing a window assembly (10) in accordance with the present invention includes six steps. Those steps are: installing a window frame (10) having a jamb (18) in a structure having a frame head (22) with a channel (45); positioning an upper sash (14) having two vertical stiles (26) and (28), an upper rail (30) and a lower rail (31), within the window frame (12) at an offset vertical angle (48); raising the upper sash (14) at the angle (48) such that the upper sash (14) extends into the channel (45) of the frame head (22); lifting the upper sash (14) into a space of the channel (45) to a position where the lower rail (31) is vertically above an upper sash support (80) coupled to the jamb (18); aligning the upper sash (14) with the upper sash support (80); and placing the upper sash (14) on the upper sash support (80).

2 Claims, 4 Drawing Sheets

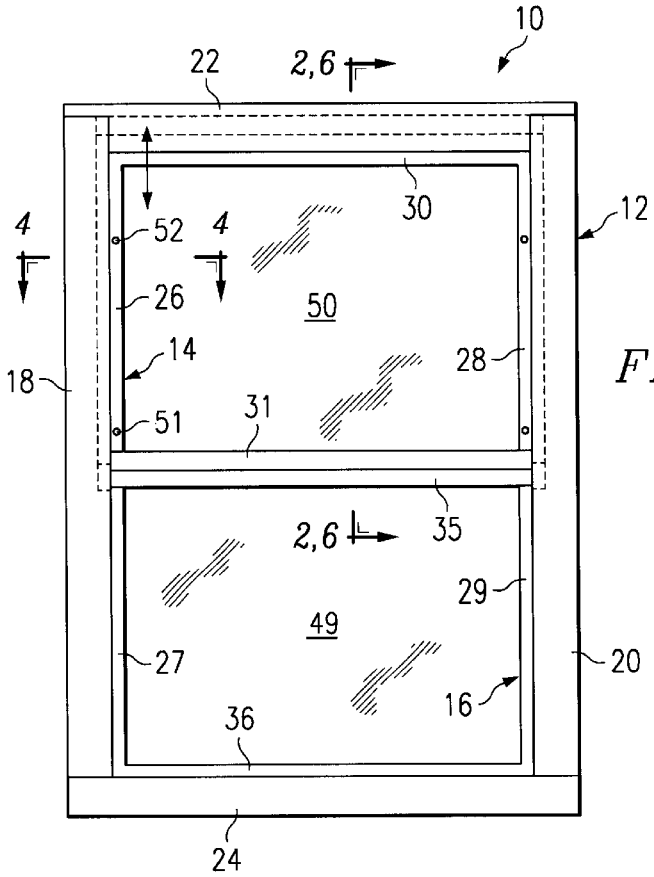
FIG. 1
FIG. 4
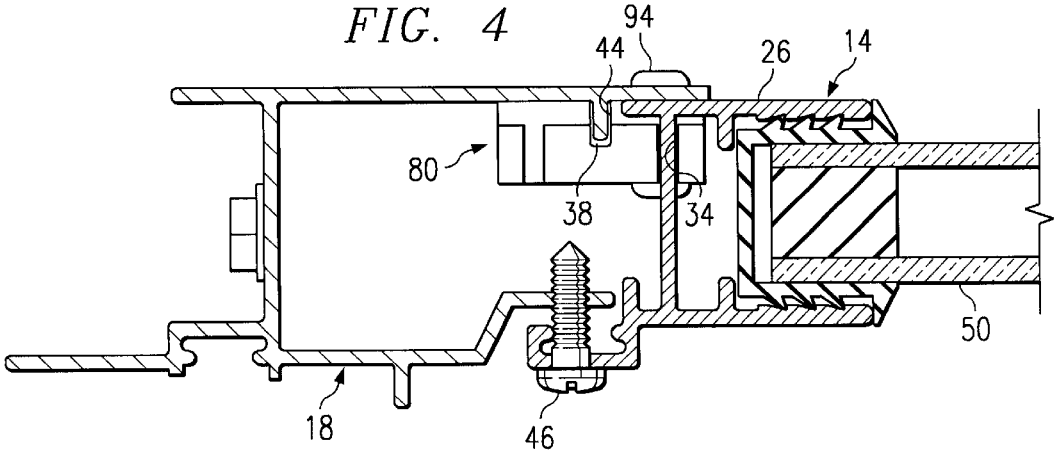

METHOD AND APPARATUS FOR INSTALLING A WINDOW ASSEMBLY

TECHNICAL FIELD OF THE INVENTION

This invention relates generally to the field of fenestration and more particularly to a method and apparatus for installing a window assembly.

BACKGROUND OF THE INVENTION

A need has arisen for window assemblies with fixed but removable upper sashes. Removal of the upper sash is necessary for two primary reasons. One, if the window is on an upper story of a building, the sash needs to be removed to facilitate cleaning, access to a fogged insulated glass unit, or convenient replacement of broken glass. Secondly, contractors frequently frame up a structure, close in the walls and install the windows prior to construction of interior space. The reason for this is to limit exposure to the weather and often for bank interim financing purposes where disbursement of funds is based on the stage of construction. Consequently, the exterior of a house is often substantially complete before drywall is carried in for installation on multi-floor structures. Drywall is often brought in through the windows. Windows where the upper sash is not removable or where there is a fixed meeting rail attached to the jambs between the upper and lower sashes create a problem for the building contractor because entry of drywall and other large items is difficult.

U.S. Pat. No. 2,509,582 is an example of a window assembly with a removable upper sash. In this design, the upper sash is supported by a projection attached to the upper sash that fits into a section of the frame jamb. This approach permits deformation and bowing of the jamb. A defective jamb allows air to enter in between the window sash and the jamb, thus necessitating an expensive repair.

U.S. Pat. No. 4,831,778 is another example of a window assembly with a removable upper sash. In this design, a projection affixed to the upper sash fits into a notch in the frame jamb. This design is deficient in that, among other things, the notch does not prevent movement of the upper sash in the horizontal direction, thus the jambs may rotate.

Therefore, a need has arisen for a new method and apparatus for installing a window assembly that overcomes the disadvantages and deficiencies of the prior art.

SUMMARY OF THE INVENTION

An apparatus for installing a window assembly is disclosed. In one embodiment of the present invention, a window assembly includes a window frame, an upper sash, and an upper sash support. The window frame includes two vertical frame jambs, a frame head, and a frame sill. The upper sash includes two vertical stiles, an upper rail and a lower rail. Each vertical stile has an upper end and a lower end. At least one vertical stile lower end has a web. The upper sash support is adapted to receive the web and support the upper sash.

In another embodiment, a method for installing a window assembly in accordance with the invention comprises six steps. Those steps are (1) installing a window frame, having a jamb having a frame head with a channel, (2) securing an upper sash support to the jamb, (3) positioning the upper sash in the window frame, (4) lifting the upper sash into the channel, (5) aligning the upper sash vertically above the upper sash support, and (6) placing the upper sash on the upper sash support.

A technical advantage of the present invention is that a method for easy installation and removal of an upper sash of a window assembly is provided. Another technical advantage is that the upper sash support locates the upper sash in the vertical direction while also preventing the upper sash from moving in the horizontal direction. Another technical advantage is that the window jambs are prevented from rotating.

BRIEF DESCRIPTION OF THE DRAWINGS

For a more complete understanding of the present invention, the objects and advantages thereof, reference is now made to the following descriptions taken in connection with the accompanying drawings in which:

FIG. 1 illustrates the window assembly as viewed from the interior of a building looking outward;

FIG. 4 illustrates a horizontal cross-sectional view of the interconnection between the frame jamb, the upper sash support, and the vertical stile;

DETAILED DESCRIPTION OF THE INVENTION

Figure 2:
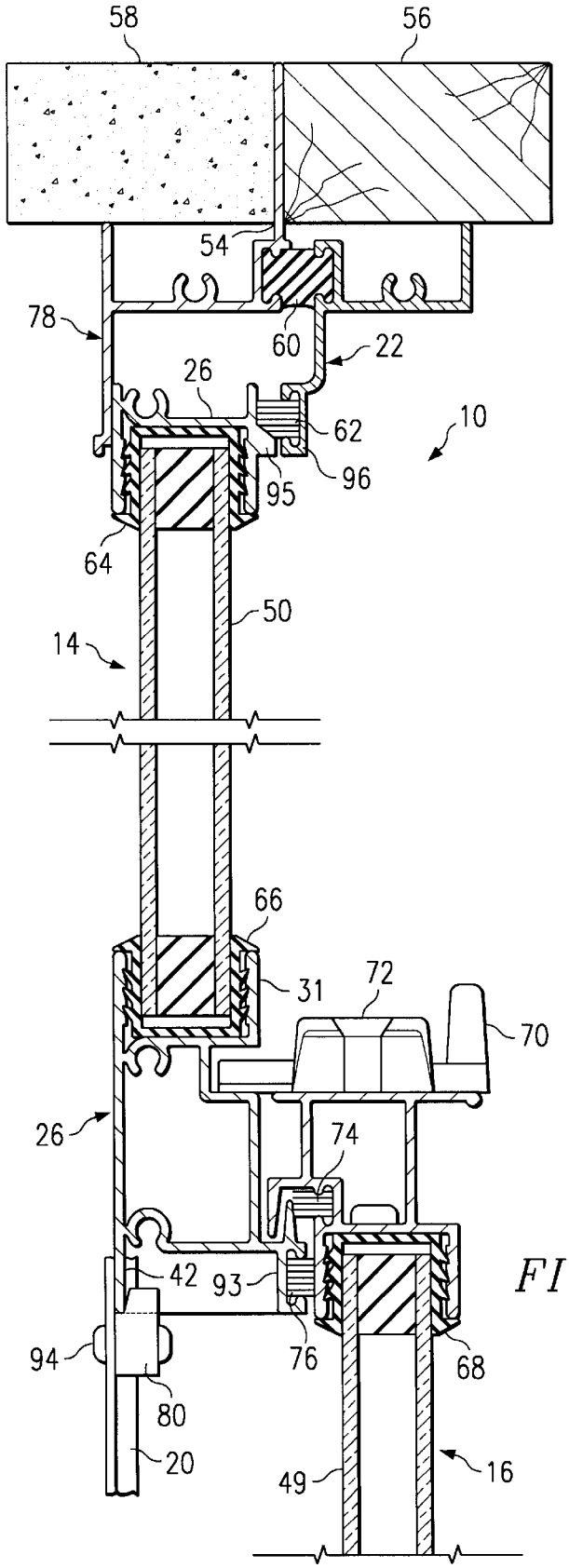
FIG. 2 illustrates a vertical cross sectional view of an installed window assembly.

The preferred embodiment of the present invention and its advantages are best understood by referring to FIGS. 1 through 6 of the drawings, like numerals being used for like and corresponding parts of the various drawings.

FIG. 1 illustrates an operating window assembly generally designated by the reference numeral 10. Window assembly 10 is suitable for use in residential and light commercial construction applications. Window assembly 10 may be referred to as a "single-hung" window in that a lower sash 16, associated with window assembly 10, may be operated vertically to provide an opening within window assembly 10 ranging from a fully closed position, to an opening approximately the size of lower sash 16. Window assembly 10 comprises a window frame 12 which at least partially surrounds an upper sash 14 and lower sash 16. Alternatively, lower sash 16 may be completely removed from and/or reinstalled within window frame 12. The removal of lower sash 16 simplifies the maintenance and repair of window assembly 10. Removal of lower sash 16 also provides an opening within window frame 12 larger than the opening available by vertical operation of the lower sash 16 while installed within frame 12.

In the illustrated embodiment, upper sash 14 may be referred to as "fixed, but removable." Upper sash 14 is considered fixed because upper sash 14 cannot be translated with respect to window frame 12 in a manner similar to lower sash 16. Upper sash 14 is considered removable because upper sash 14 may be separated from window frame 12, when circumstances warrant. In the illustrated embodiment, the removal of upper sash 14 from window frame 12 is slightly more complicated than removal of lower sash 16 from window frame 12, because removal of upper sash 14 requires the removal of associated mechanical fasteners. The fasteners are provided for additional stability and are not required for all embodiments of the present invention. For convenience, window assembly 10 of the present invention is provided as a single hung type with a moveable and removable lower sash, and a fixed, but removable upper sash 14. In alternative embodiments, the teachings of the present invention may be applied to double hung windows having one or more movable, removable sashes.

Window frame 12 forms an outer portion of window assembly 10 and comprises parallel vertical jambs 18 and 20 connecting a window head 22 at upper portions thereof, and a window sill 24 at lower portions thereof. Vertical jambs 18 and 20, head 22 and sill 24 have a generally rectangular configuration at least partially enclosing upper sash 14 and lower sash 16 therein.

Fixed, but removable upper sash 14 is stationarily positioned at least partially within window frame 12 and includes parallel vertical stiles 26 and 28, adjoining a top rail 30 at upper ends thereof, and a bottom rail 31, at lower ends thereof. Upper sash 14 at least partially encloses and supports at least one pane of glass 50. Operable and removable lower sash 16 is also positioned within and supported by window frame 12. Lower sash 16 includes parallel vertical stiles 27 and 29 adjoining top rail 35 at upper ends thereof, and adjoining bottom rails 36 at lower ends thereof. Vertical stiles 27 and 29, top rail 35, and bottom rail 36 form a rectangular perimeter of lower sash 16 and enclosed at least one pane of glass 49. Other than glass panes 49 and 50, window assembly 10 is generally comprised of aluminum alloy components, within the illustrated embodiment. Other appropriate materials include metals, composites, and wood which may be used to form components of window assembly 10, within the teachings of the present invention.

Additional components of window assembly 10 are illustrated in FIG. 2. Window assembly 10 is generally positioned within an opening 54 at the juncture between building interior 56 and exterior 58. Window head 22 is secured between building interior 56 and exterior 58. A thermal break 60 is positioned between components of window head 22. A weatherstrip 62 is provided at the juncture between top rail 30 of upper sash 14 and window head 24. Weatherstrip 62 seals potential gaps between window head 22 and upper sash 14, and accommodates the removal of upper sash 14 from window frame 12, as discussed later in greater detail. A plurality of vinyl glazing gaskets 64 and 66 secure glass pane 50 within upper sash 14. Similarly, a perimeter vinyl glazing gasket 68 secures glass pane 49 within lower sash 16.

A cam lock 70 may be coupled with lower sash 16 using a flathead Phillips type screw 72, or other mechanical fastener. Cam lock 70 provides a means to secure lower sash 16 with respect to upper sash 14. Cam lock 70 has a first position which allows lower sash 16 to slide vertically with respect to upper sash 14, and a second position which prevents such motion. When cam 70 is in a locked position, upper sash 14 and lower sash 16 are secured in place and with respect to one another, and window assembly 10 cannot be opened by an individual standing on the side adjacent to building exterior 58. Finseals 74 and 76 may also be provided to prevent gaps between window upper sash bottom rail 31 and lower sash 16.

Figure 3:
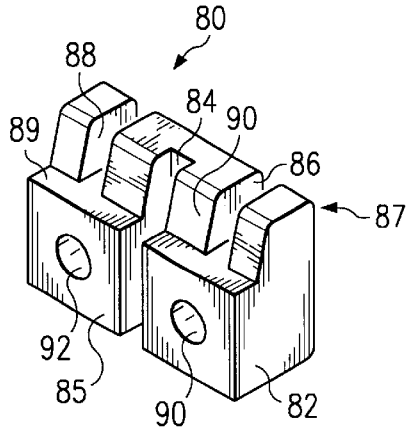
FIG. 3 is a perspective view of the upper sash support.

In the installed position of upper sash 14, vertical stile 26 rests within a channel 78 formed within window head 22. Bottom rail 31 of upper sash 14 is supported by an upper sash support 80. A symmetric drawing of upper sash support 80 is illustrated in FIG. 3. Upper sash support 80 comprises a main body 82 having a vertical slot 84 formed within a front face 85 of main body 82. A pair of vertical slots 86 and 88 are provided at a rear face 87 of main body 82. Apertures 90 and 92 cooperate with at least one rivet 94 (FIG. 2) to couple upper sash support 80 with vertical jamb 18.

Figure 5:
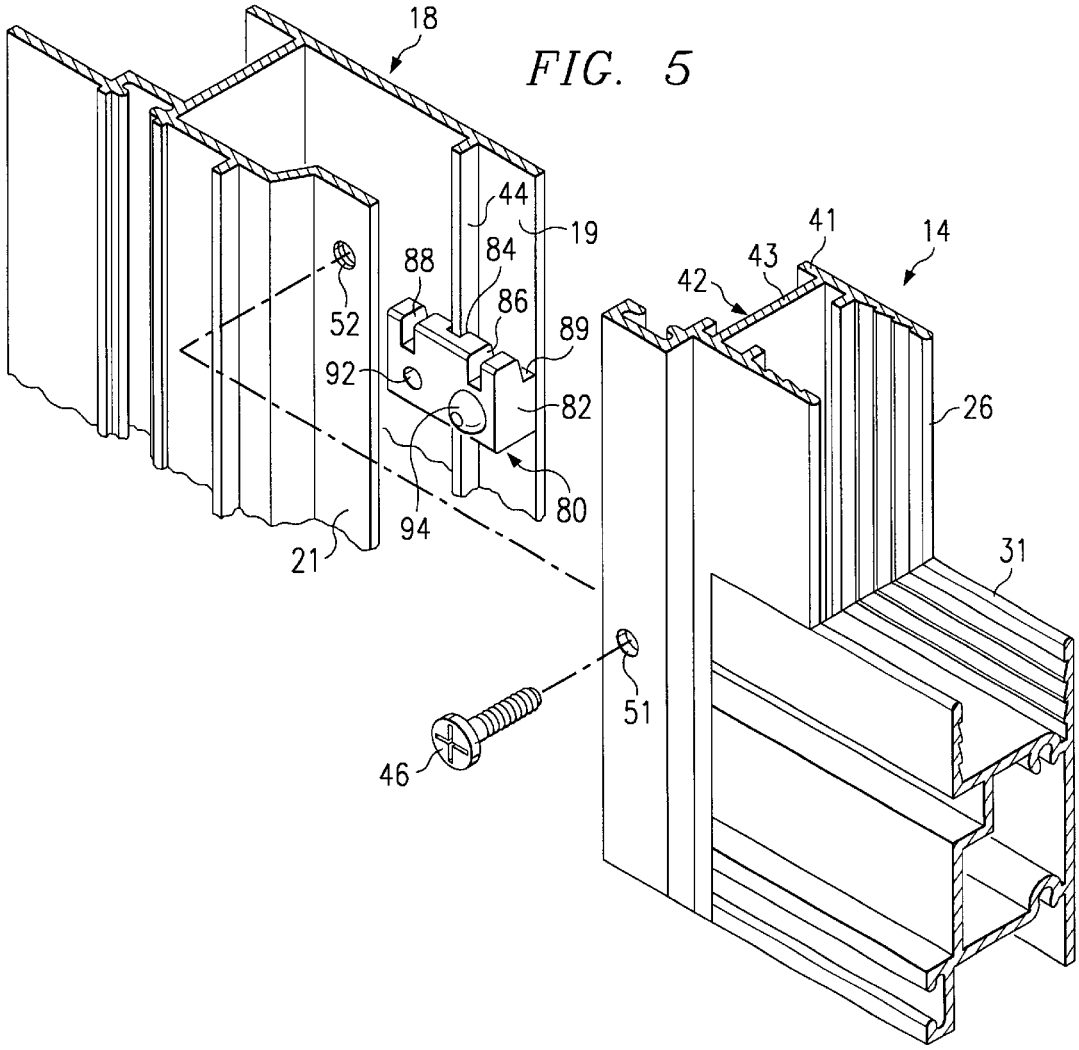
FIG. 5 is a perspective view of an upper sash support coupled to the frame jamb and a perspective view of the juncture of the stile and lower rail.

The cooperation between upper sash support 80, upper sash 14 and vertical jamb 18 is illustrated in FIGS. 3–5. Vertical slot 84 is operable to receive a protruding wall 44 (FIG. 4) associated with vertical jamb 18. Rivet 94 couples vertical jamb 18 with upper sash support 84. The cooperation between vertical slot 84 and protruding wall 44 prevent rotation of upper sash support 80 about an imaginary vertical axis through protruding wall 44. The cooperation between upper sash support 80 and vertical jamb 18 also prevents horizontal motion of upper sash support 80 with respect to vertical jamb 18 along a plane parallel with glass pane 50.

As illustrated in FIG. 4, one rivet 94 is needed to secure upper sash support 80 with vertical jamb 18. Aperture 90 is not utilized in the illustrated embodiment. Aperture 90 is provided to allow a single 'non-handed' sash support 80, which allows upper sash support 80 to be used interchangeably on either vertical jamb 18 or 20. In another embodiment, a second rivet may be provided for additional strength at the connection between upper sash support 80 and vertical jamb 18. Many other mechanical fasteners may be used in lieu of rivet 94 including, but not limited to, screws, bolts, and nails.

In the illustrated embodiment, each vertical jamb 18 and 20 includes an upper sash support 80 to cooperate with vertical stiles 26 and 28 (FIGS. 1 and 5), respectively. A single upper sash support 80 coupled with either of vertical jambs 18 or 20 may be suitable to support upper sash 14, within the teachings of the present invention. As illustrated in FIG. 5, upper sash support 80 is coupled with vertical jamb 18 along an outer wall 19 of vertical jamb 18. Outer wall 19 of vertical jamb 18 provides greater load bearing capacity than available from inner wall 21 of vertical jamb 18. Accordingly, upper sash support 80, when coupled with vertical jamb 18, may carry a greater load, or heavier upper sash without excessive deformation or failure. It will be recognized by those skilled in the art that the number, size, configuration and location of upper sash support 80 with respect to vertical jamb 18 may be significantly modified within the teachings of the present invention.

Referring to FIG. 5, the cooperation between vertical jamb 18 and upper sash 14 is illustrated in detail. A similar configuration exists with respect to a second upper sash support 80, vertical jamb 20 and upper sash 14. Accordingly, only vertical jamb 18, upper sash support 80 and upper sash 14 will be described in detail for illustrative purposes. Vertical stile 26 comprises an I-shaped beam 42 which extends downwardly beyond top rail 35 of lower sash 16. Beam 42 is configured to cooperate with upper sash support 80 to secure upper sash 14 in its fixed, but removable position. A web portion 43 of beam 42 cooperates with vertical slot 86 to prevent movement of upper sash 14 with respect to upper sash support 80. The configuration of vertical slot 86 prevents motion of upper sash 14 along a horizontal axis perpendicular with and through each aperture 90 and 92. Therefore, vertical slot 86 prevents deformation of jamb 18 and upper sash 14, while upper sash 14 is installed within window assembly 10. This prevents jamb 18 from deforming either toward vertical jamb 20 or away from vertical jamb 20. In many windows, jamb deformation due to the lack of a horizontal cross support between vertical jambs, creates problems including gaps between components of the window assembly, excessive deformation, and failure. Due to the configuration of upper sash support 80 and the cooperation between upper sash support 80, vertical jamb 18 and upper sash 14, bottom rail 31 functions as a horizontal cross support between vertical jambs 18 and 20.

A flange 41 associated with beam 42 cooperates with a ledge 89 formed within main body 82. Ledge 89 prevents upper sash 14 from movement vertically downward, or parallel with vertical stile 18. A front face 90 formed perpendicular to and adjacent ledge 89 prevents motion of upper sash 14 horizontally toward lower sash 16. In its locked position, screw 46 prevents movement of upper sash 14 vertically upward. A C-shaped channel 93 associated with bottom rail 21 of upper sash 14 cooperates with top rail 35 of lower sash 16 to further prevent movement of upper sash 14 vertically upward, along an imaginary horizontal axis perpendicular with glass pane 50. Accordingly, upper sash support 80 and vertical jamb 18 cooperate to prevent movement of upper sash 14 in virtually any direction other than vertically upward, when upper sash 14 is properly installed.

In the illustrated embodiment, mechanical fastener 46 may be inserted through fastener opening 51 of upper sash 14 and fastener opening 52 within vertical jamb 18, to secure upper sash 14 with vertical jamb 18. For particular embodiments, fastener 46 may be omitted, or used primarily for packing and shipping to prevent movement of vertical jamb 18 with respect to upper sash 14.

Figure 6:
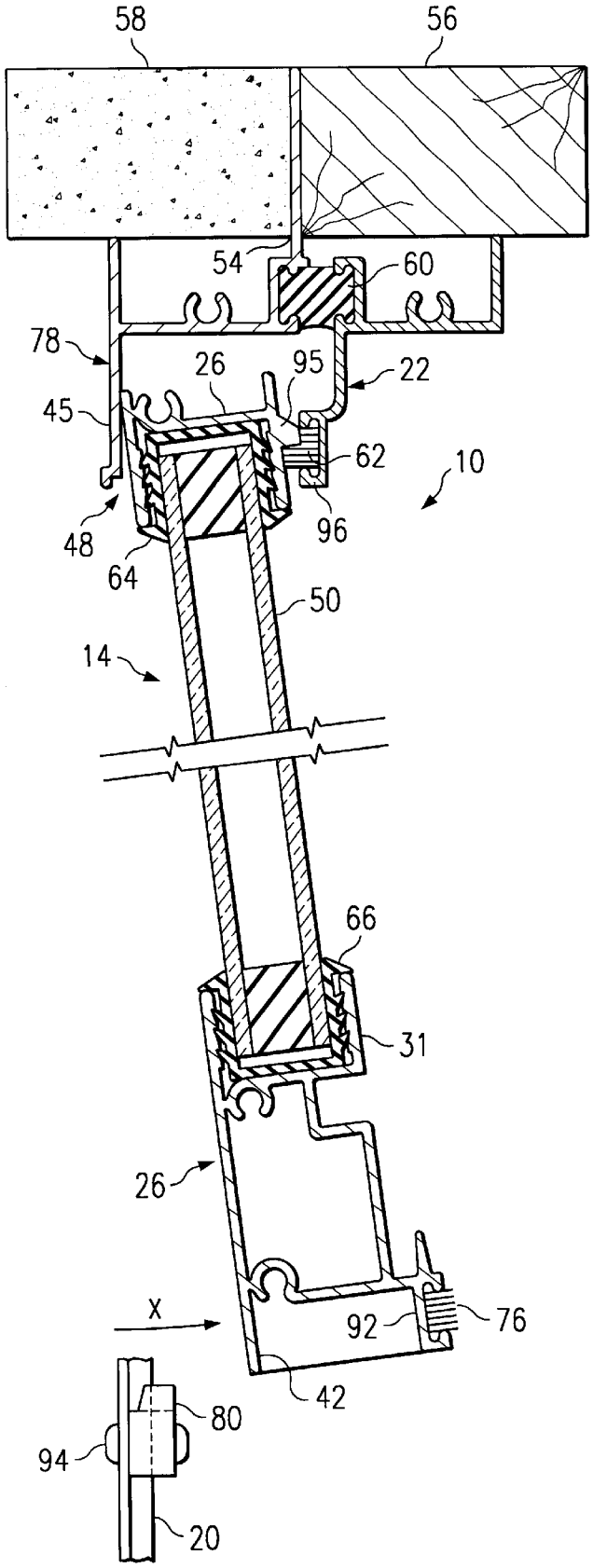
FIG. 6 illustrates the method of installing and removing the upper sash.

The operation of removable upper sash 14 is illustrated in FIGS. 2 and 6. In order to remove upper sash 14, lower sash 16 must first be removed from window frame 12. Also, any mechanical fasteners coupling upper sash 14 with any portion of window frame 12, including mechanical fastener 46, must be removed. In order to remove upper sash 14, upper sash 14 must be positioned at an offset angle generally designated by the reference numeral 48, with respect to an imaginary axis connecting and parallel with vertical jambs 18 and 20. This allows protrusion 95 to clear C-shaped channel 96, and upper sash 14 may be raised vertically upward. This causes upper sash 14 to extend within channel 78. Upper sash 14 may then be lifted within channel 78 to a position where lower rail 31 is vertically above upper sash support 80. Upper sash 14 may then be rotated inward in the direction indicated by direction arrow labeled X until upper sash 14 clears upper sash support 80. Upper sash 14 may then be lowered until top rail 30 clears window head 22 and upper sash 14 may be freely removed from window frame 12.

Removal of upper sash 14 accommodates a safer and more effective method for cleaning, repairing or maintaining window assembly 10. Furthermore, removing upper sash 14 provides a greater clear opening within window frame 12 which may be helpful for loading materials through window assembly 10 to the interior of a building or structure. Such materials may include construction equipment, drywall, furnishings, etc. Upper sash 14 may be conveniently reinstalled upon completion of such tasks.

In order to install upper sash 14 within window frame 12, upper sash 14 must be positioned adjacent channel 45 of window head 22 at an offset angle 48 with respect to an axis through the plane of window frame 12. Next, upper sash 14 may be raised vertically upward while maintaining angle 48, such that upper sash 14 extends into channel 78 of frame head 22. Upper sash 14 should then be lifted to a position where lower rail 31 is vertically above upper sash support 80. Upper sash 14 may then be aligned with upper sash support 80 such that vertical slot 86 cooperates with web 43 as illustrated in FIG. 4.

While the invention has been particularly shown and described by the foregoing detailed description, it will be understood by those skilled in the art that various other changes in form and detail may be made without departing from the spirit and scope of the invention.

What is claimed is:

1. A window assembly, comprising:

a window frame having two vertical frame jambs, a frame head, and a frame sill;

an upper sash having two vertical stiles, an upper rail and a lower rail, each vertical stile having an upper end and a lower end, the lower end of at least one vertical stile having a web; and a sash support coupled with the window frame, the sash support adapted to receive the web and support the upper sash; and the lower end of each vertical stile includes respective webs and wherein the sash support comprises at least two slots complementary to each web, and at least two apertures formed to receive one or more mechanical fasteners.

2. A sash support, comprising:

a body having a front face, a rear face, and first and second sides;

a ledge extending from the first side to at least a position generally intermediate the first and second sides;

the body defining a first slot extending along the front face generally parallel to the first and second sides;

the body further defines a second slot proximal the first side, the second slot extending along an upper portion of the body generally parallel to the first and second sides; and the body further defines a third slot proximal the second side, the third slot extending along an upper portion of the body generally parallel to the first and second sides.

* * * * *